US007400848B2

(12) United States Patent
Kimura

(10) Patent No.: US 7,400,848 B2
(45) Date of Patent: Jul. 15, 2008

(54) TONER CARTRIDGE AND MECHANISM OF INSTALLING AND REMOVING THE SAME

(75) Inventor: Hisashi Kimura, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 376 days.

(21) Appl. No.: 11/179,500

(22) Filed: Jul. 13, 2005

(65) Prior Publication Data

US 2006/0013620 A1 Jan. 19, 2006

(30) Foreign Application Priority Data

Jul. 15, 2004 (JP) ..... 2004-209007

(51) Int. Cl.
*G03G 15/08* (2006.01)

(52) U.S. Cl. ..... 399/262

(58) Field of Classification Search ..... 399/120, 399/258, 262, 263; 222/DIG. 1
See application file for complete search history.

(56) References Cited

U.S. PATENT DOCUMENTS 5,812,914 A * 9/1998 Johroku ..... 399/262
6,259,877 B1 7/2001 Taniyama et al.
6,292,644 B1 * 9/2001 Goto et al. ..... 399/262
7,062,205 B2 * 6/2006 Nagashiro ..... 399/258
7,302,213 B2 * 11/2007 Kimura et al. ..... 399/262
2002/0164179 A1 * 11/2002 Hosokawa ..... 399/258

FOREIGN PATENT DOCUMENTS

EP 843233 A2 * 5/1998
JP 04350871 A * 12/1992
JP 06149047 A * 5/1994
JP 07199620 A * 8/1995
JP 08297403 A * 11/1996
JP 09114219 A * 5/1997
JP 09179363 A * 7/1997
JP 2001-235935 A 8/2001

OTHER PUBLICATIONS

U.S. Appl. No. 11/180,602, filed Jul. 14, 2005, Kimura et al.

* cited by examiner

*Primary Examiner*—Robert Beatty
(74) *Attorney, Agent, or Firm*—Foley & Lardner LLP

(57) ABSTRACT

In accordance with a replacing mechanism of the present invention, a toner cartridge is replaced from a main body of an image forming apparatus by performing, in a substantially same timing, an operation of closing a toner pouring opening with a cover by a levering action; and an operation of displacing the toner cartridge from the main body of the image forming apparatus to an operater side, the toner cartridge being provided with a flange portion. The toner cartridge cannot be pulled out unless the toner pouring opening is fully closed by the shutter member.

4 Claims, 4 Drawing Sheets

TONER CARTRIDGE AND MECHANISM OF INSTALLING AND REMOVING THE SAME

CROSS-REFERENCE TO RELATED APPLICATIONS

This application is based upon and claims the benefit of priority from the prior Japanese Patent Application No. 2004-209007, filed on 15th Jul. 2004, the entire content of which is incorporated herein by reference.

BACKGROUND OF THE INVENTION

1. Field of the Invention

The present invention relates generally to a toner cartridge and a mechanism of installing and removing the same for use in an image forming apparatus, such as a copying machine. More specifically, the present invention relates to a toner cartridge and a mechanism of installing and removing the same suitable for replacement of the toner cartridge.

2. Description of the Related Art

In a typical image forming apparatus such as a copying machine, printed information is generated on paper from image information as given to be copied by electrifying the surface of a photoreceptor drum, exposing the electrified surface of the photoreceptor drum to the image information to form a latent image, attracting toner to the photoreceptor drum to form a visible image, transferring the visible image of the toner to a sheet of paper, applying heat and pressure to the sheet of paper to fix the image information onto the sheet of paper, and cleaning and neutralizing the sheet of paper. In the developing process of forming the visible image, the toner is used as developer as well as a carrier made of a magnetic material.

The carrier which is a main component of the developer is used to provide electricity by frictional electrification and transport the toner. This carrier is used to electrify the photoreceptor drum for the purpose of attracting the toner onto the photoreceptor drum and then transferring it to paper, and therefore the carrier shall not be consumed and decreased by its attachment to paper. In contrast to this, while printed material is produced by transferring, fixation, cleaning and the like steps, the toner is consumed after each use and becomes gradually less. Accordingly, after the use of the image forming apparatus for a certain period of time, the toner must be supplied.

In order to appropriate supplying toner from a toner cartridge while preventing toner leakage during a replacement operation, it is proposed that a cap is attached to the toner container of a toner cartridge, and fitted into a cylindrical cover which is displaced in use to open a discharge port of the cap through which toner can be discharged by rotating in this state the toner container and moving forward the toner, while the cover serves to close the discharge port for example when this toner cartridge is removed in order to prevent leakage of toner (for example, as described in Japanese Patent Published Application No. 2001-235935).

However, in the case of replacement of such a conventional toner cartridge, the toner cartridge is pulled out from the main unit by putting hand on a suitable location of the toner cartridge so that the toner cartridge may be loose and sometimes broken.

BRIEF SUMMARY OF THE INVENTION

According to embodiments of the present invention, it is an object to provide a toner cartridge which can be installed into and removed from the main body of an image forming apparatus in a simply way without fear of damaging it.

The present invention may provide a toner cartridge, comprising:

a rotary transport mechanism that contains a toner therein, has a toner pouring opening, and is configured to transport the toner contained therein to the toner pouring opening;

a toner cartridge body having a flange portion;

a shutter member provided on said toner cartridge body, and configured to freely slide between a close position in which said toner pouring opening is closed and an open position in which said toner pouring opening is opened;

a first engagement member that engages with this shutter member and, when said toner cartridge is inserted into a predetermined setting position of the main unit of said toner supply apparatus, restricts the movement of said shutter member in the direction opposite the insertion direction in relation to the main unit of said toner supply apparatus and engages with a predetermined member of the main unit of said toner supply apparatus;

a second engagement member that engages with said toner cartridge body and/or said shutter member, and restricts said shutter member to the close position when said toner cartridge is replaced from the predetermined setting position of the main unit of said toner supply apparatus; and an engagement release mechanism that, when said toner cartridge is replaced, engages with the predetermined member of the main unit of said toner supply apparatus in order to release the engagement of said first engagement member, and restricts said shutter member to the close position by sliding said toner cartridge body in the removal direction and engaging said toner cartridge body with said second engagement member.

The present invention may provide a replacing mechanism of replacing a toner cartridge from a main body of an image forming apparatus by performing, in a substantially same timing, an operation of closing a toner pouring opening with a cover by a levering action; and an operation of displacing said toner cartridge from the main body of said image forming apparatus to an operater side, said toner cartridge being provided with a flange portion.

DETAILED DESCRIPTION OF THE INVENTION

Throughout this description, the embodiments and examples shown should be considered as exemplars, rather than limitations on the apparatus and methods of the present invention.

In what follows, one embodiment of the present invention will be explained with reference to the accompanied drawings as an example.

Incidentally, like reference numbers indicate the same elements throughout the drawings. In the following description of the embodiment, a copying machine is explained as an exemplary image forming apparatus whose structure is specifically described as well as the toner cartridge of this copying machine.

First, the outline structure of the copying machine is explained, while the illustration of details is omitted because the basic mechanism thereof is well-known in the field.

The copying machine includes an optical system for exposure scanning an original which is placed on a transparent flatbed plate and guiding reflected light from the original to a photoreceptor drum, an image generation system for visualizing an electrostatic latent image on the photoreceptor drum by the use of a development apparatus and transferring the visualized image to a sheet of paper, and a fixing apparatus for fixing the visualized image of toner onto the sheet of paper with heat, and provided with a paper transportation mechanism for transporting the sheet of paper from a paper feed tray to a paper output tray through the image generation system.

The image generation system comprises an electricity charger, the development apparatus, an image transfer charger and a cleaning apparatus which are arranged in this order around the photoreceptor drum. This image generation system forms an electrostatic latent image by focussing an image of a original on the outer peripheral surface of the photoreceptor drum which is generally and uniformly electrified in order to form the electrostatic latent image, visualizing this electrostatic latent image as a toner image by the development apparatus, transferring the toner image to a sheet of paper by the transfer charger, and recovering residual toner by the cleaning apparatus.

Figure 3:
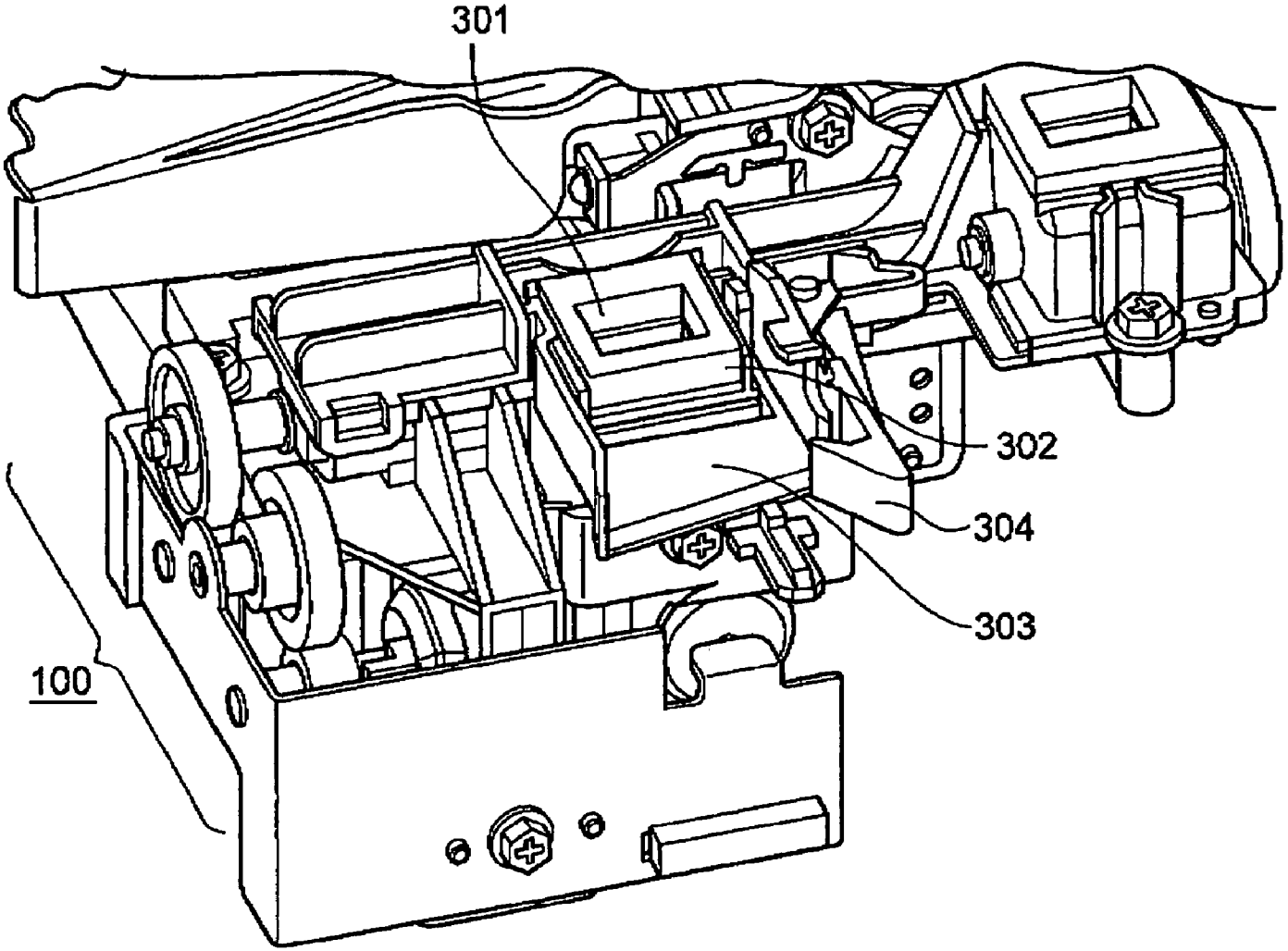
FIG. 3 is a perspective view showing the primary portion of a development apparatus of the image forming apparatus.

FIG. 3 shows the primary portion of the development apparatus and its peripheral structure of the copying machine.

A toner supply apparatus is located above the development apparatus 100 and serves to supply the development apparatus 100 with toner. The toner supply apparatus is provided with a toner cartridge containing toner to be supplied, and a main unit having a guide member for enabling the toner cartridge to be set up and freely pulled out, and guiding the insertion and removal of the toner cartridge.

Next, the main unit of the toner supply apparatus will be explained. The main unit of the toner supply apparatus is provided with a toner hopper. The toner hopper has an opening in part of its upper surface as a toner supply port 301 and is a box unit which is formed of an appropriate synthetic resin in a substantially rectangular shape and located within the development apparatus 100. Also, the periphery of the toner supply port 301 is enclosed by a sealing frame 302. In addition, a nozzle cover 303 is provided in a position slightly below the sealing frame 302. In the toner hopper, a circulation path is provided as well as a churn transport structure which stirrs the toner by circulating it along the circulation path and supplies the circulating toner into the development apparatus through a toner output port provided at the end of the circulation path. For example, the toner hopper is provided with a toner amount detecting device. This toner amount detecting device detects that the amount of toner in the toner hopper decreases to a predetermined value, and outputs a detection signal indicative of this fact to a control unit. In response to the detection signal output from the toner amount detecting device, the control unit provides an alarm by an alarming device to indicate that toner is consumed in the toner hopper. Incidentally, as illustrated in FIG. 3, there is a hook member 304 (to be described below) at the side of a nozzle cover 303.

Figure 1:
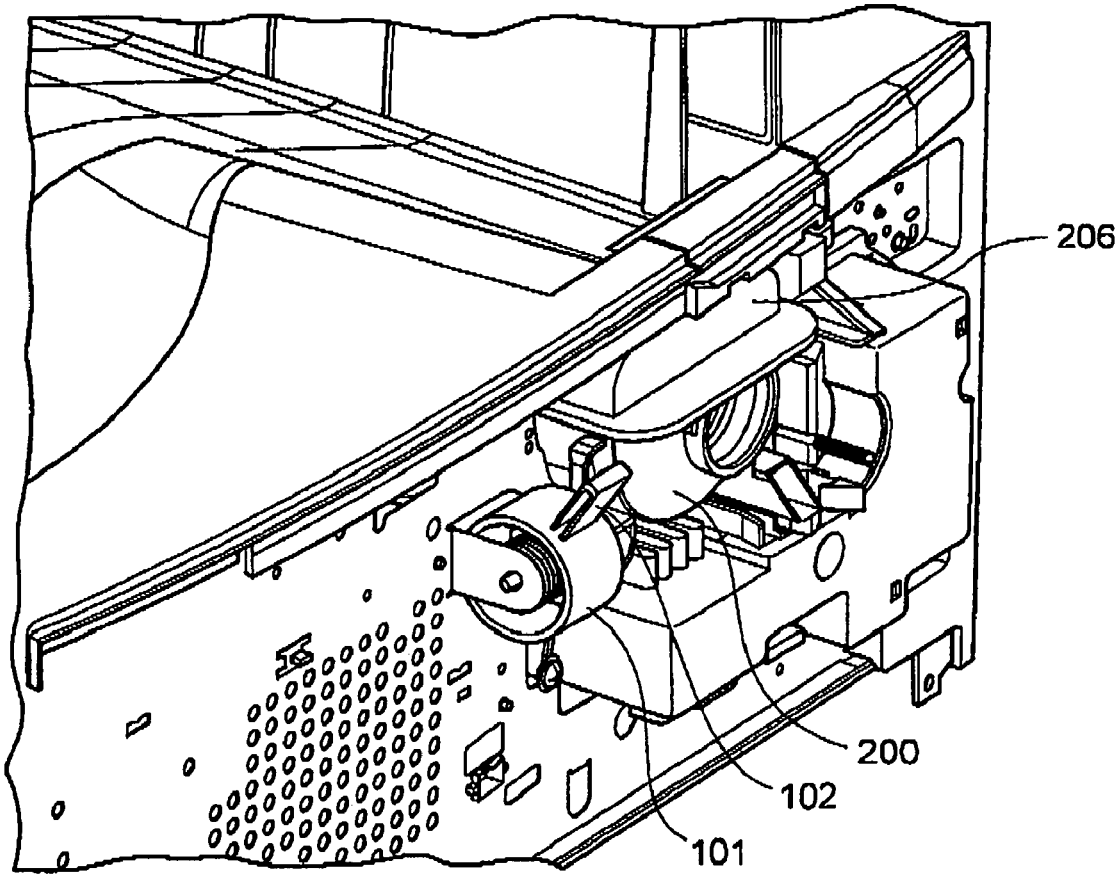
FIG. 1 is a perspective view showing a toner cartridge in accordance with the embodiment of the present invention which is installed in an image forming apparatus.
Figure 2:
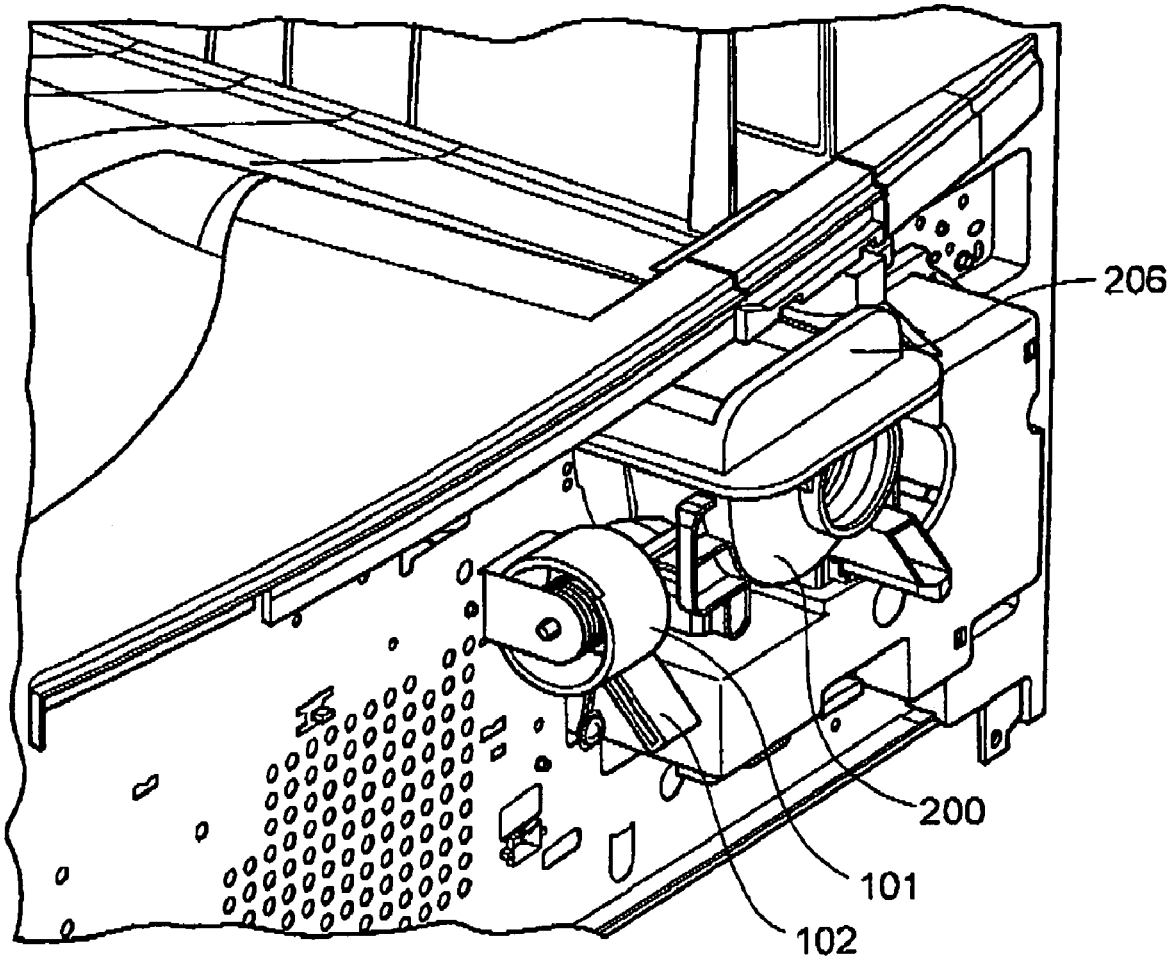
FIG. 2 is a perspective view showing the toner cartridge in accordance with the embodiment of the present invention after performing an operation required for installing or removing the toner cartridge into or from the image forming apparatus.

FIG. 1 is a perspective view showing the toner cartridge in accordance with the embodiment of the present invention which is installed in the copying machine, in which an inner cover is omitted for a better understanding. On the other hand, FIG. 2 shows the toner cartridge in accordance with the embodiment of the present invention after performing an operation required for installing or removing the toner cartridge into or from the image forming apparatus.

Figure 4:
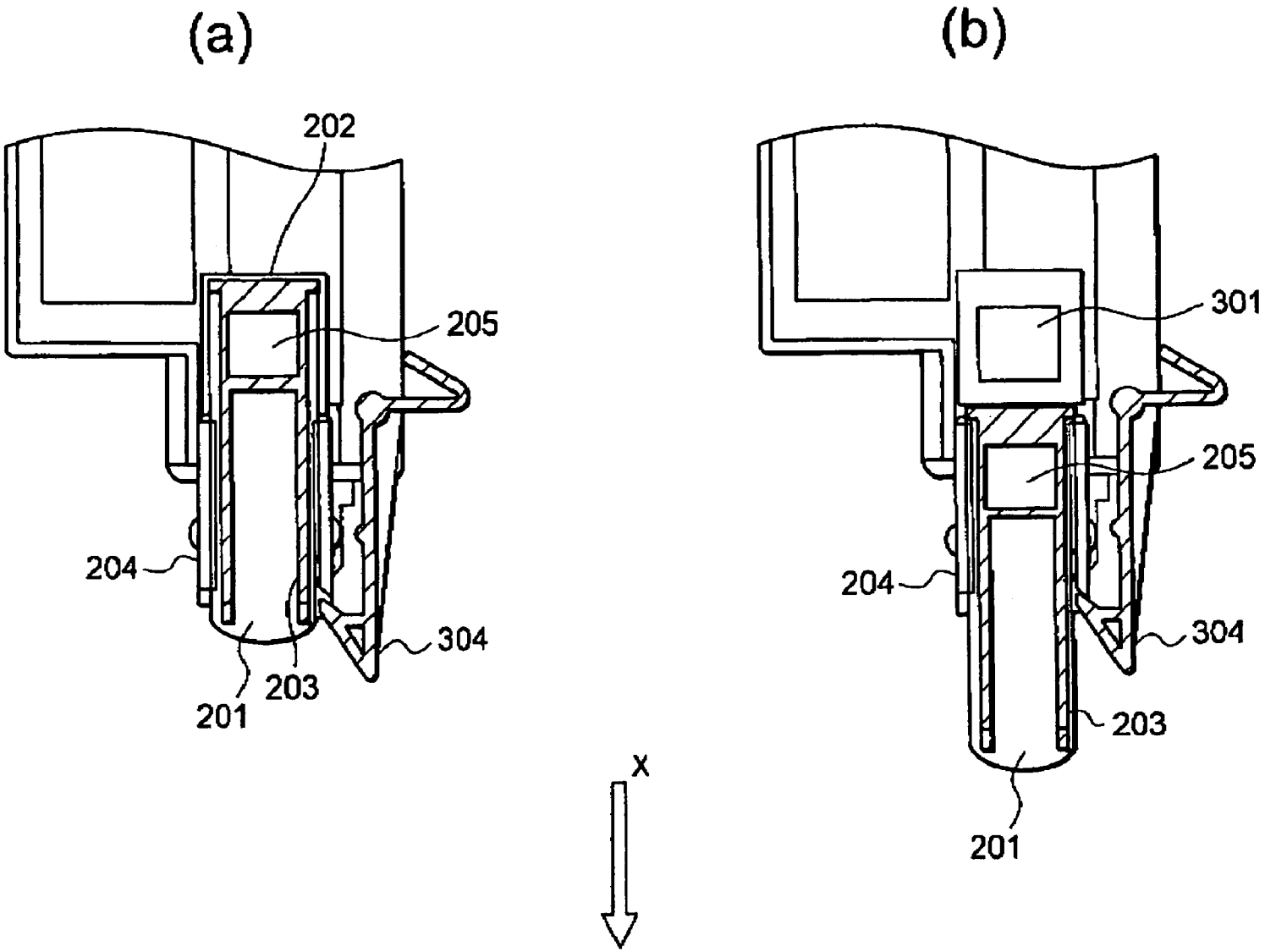
FIG. 4 is a diagrammatic and cross sectional view for explaining the insertion and removal of the toner cartridge in accordance with the embodiment of the present invention.

FIG. 4 is a diagrammatic and cross sectional view for explaining the insertion and removal of the toner cartridge in accordance with the embodiment of the present invention. In FIG. 4, the main unit of the toner supply apparatus is provided with a guide member 201 and an installation member 202 for setting, in a predetermined setting position, the toner cartridge 200 which is guided by the guide member 201 for insertion and removal.

The guide member 201 has a pair of guide rails 203 along an X-direction which is a direction to insert and remove the toner cartridge 200. These guide rails 203 serves to engage with a shutter member 204 of the toner cartridge 200 to be described below. More specifically, the guide member 201 is designed to engage the shutter member 204 in order that the shutter member 204 moves to an open position when the toner cartridges 200 is inserted.

Also, at the end of the installation member 202 in the direction opposite the X-direction, a positioning contact surface (not shown in the figure) is formed to restrict the movement of the the guide member 201 of the shutter member 204 in the X-direction by coming in contact with the end of the shutter member 204 in the X-direction after sliding the shutter member 204 on the the guide member 201.

The toner cartridge 200 is provided with a container body which contains toner and has a toner discharge opening 205 in its bottom surface, a sealing member (not shown in the figure) which is detachably mounted on the bottom surface of the container body and serves to close the toner discharge opening 205, and the shutter member 204 which is provided to slide along the bottom of the container body. The container body is made of a synthetic resin and provided with a flange portion 206 in an upper position of one side thereof. An operator can get his finger caught in this flange portion 206 when the toner cartridge is installed or removed. Also, a toner filling hole (not shown in the figure) is formed, for example, through an end wall in the front side of the container body. This toner filling hole is stopped, for example, by a plug after filling the container body with toner. In the bottom surface of the container body, for example, there are guide grooves formed extending in the longitudinal direction in parallel in order to fit onto the L-shaped guide rails 203, for example, in the both sides of the toner discharge opening 205.

The above sealing member is made, for example, of a synthetic resin film, and removably adhered to the periphery of the toner discharge opening 205 by welding or with an adhesive such that the toner discharge opening 205 is blocked. This sealing member is removed when a new toner cartridge 200 is installed into the main unit of the toner supply apparatus.

The shutter member 204 slides in relation to the toner cartridge 200 and moves between a close position in which a toner pouring opening is closed and an open position in which the toner pouring opening is opened. The shutter member 204 remains in the open position when the toner cartridge body is set up in a predetermined location, and can slide to the close position when the toner cartridge is removed. This shutter member 204 may be made of an appropriate synthetic resin.

A first engagement member is provided for guiding the movement of the shutter member 204 to the open position when the toner cartridge 200 is inserted into the predetermined setting position of the main unit of the toner supply apparatus, and then engaging with a predetermined member of the main unit of the toner supply apparatus. For example, the leading end of this first engagement member is engaged with an engagement protrusion (not shown in the figure) which is provided on the shutter member 204. For example, the first engagement member is preferably designed as a locking mechanism which includes the flexible hook member 304, which can be hooked to the side portion of the toner cartridge body, and serves to align the toner pouring opening of the toner cartridge body and the toner supply opening of the toner supply apparatus with each other in the vertical direction when the toner cartridge 200 is located in the predetermined setting position of the main unit of the toner supply apparatus. Also, the hook member 304 can be made for example of polypropylene.

Furthermore, there is a second engagement member which engages with the toner cartridge 200 such that the shutter member 204 is restricted to the close position when the toner cartridge 200 is replaced from the predetermined setting position of the main unit of the toner supply apparatus. For example, this second engagement member is designed to engage with the toner cartridge body and the shutter member 204.

Furthermore, an engagement release mechanism is provided for, when the toner cartridge 200 is removed, engaging with the predetermined member of the main unit of the toner supply apparatus in order to release the engagement of the first engagement member, and restricting the shutter member 204 to the close position by sliding the toner cartridge body in the removal direction and engaging the second engagement member in order to restrict the shutter member 204 to the close position.

This engagement release mechanism is provided with a rotatable member 101 having a lever member 102, a restriction member (not shown in the figure) for permitting the rotation of this rotatable member 101 but restricting the rotation within a predetermined range, and a follower member (not shown in the figure) which is located in a position displaced from the rotation center of this rotatable member 101, engaged with the side portion of the cartridge body, and capable of moving in a straight line as the rotatable member 101 rotates.

The lever member 102 of the rotatable member 101 is gripped with fingers by an operator such that it can be desiged to have an appropriate size and shape. Incidentally, the rotatable member 101 and the lever member 102 may be integrally moulded.

The rotatable range of the rotatable member 101 is from the position in which the toner cartridge 200 is set up to the position from which the toner cartridge 200 can be removed. For this purpose, the restriction member (not shown in the figure) is provided for restricting the rotation of this rotatable member 101. This restriction member is provided for example with a guide membe having a long hole which is formed corresponding to the rotatable range, and a shaft formed on the side surface of the rotatable member is inserted into the long hole of the guide member. Furthermore, for example, it is preferred that a compression spring is mounted on the rotatable member 101 to provide an appropriate friction in order to prevent the rotatable member 101 from unintentionally rotating.

Next is a description of the operation of removing and installing the toner cartridge 200 from and into the main body of the toner supply apparatus 300.

1) First of all, in advance of replacing the toner cartridge 200, the main body of the copying machine must be opened by opening an openable cover which is part of the front face of the main body of the copying machine, such that it is possible to replace the toner cartridge 200 which may be used up with a spare thereof by the use of the guide member. The openable cover can be pivotted around a horizontal axial line extending along the front face in order to open and close the inside of the main body of the copying machine. The copying machine is closed by raising the openable cover to its upright position after completing setting up the toner cartridge 200.

2) Next, the shutter member 204 located in the close position of a spare of the toner cartridge 200 is opened by sliding it, and the sealing member is removed by peeling off. After peeling off the sealing member, the shutter member 204 is returned to the close position again. Then, the toner cartridge 200 is pushed inside by sliding in the X-direction on the guide member.

3) The shutter member 204 is engaged with the guide member when completely supported by the guide member, and prevented from further moving in the X-direction and the opposite direction in relation to the guide member. The movement of the shutter member 204 is prevented in the X-direction by the positioning contact surface of the installation member 202 and in the opposite direction by the first engagement member.

4) After the movement of the shutter member 204 is prevented, the toner cartridge 200 is set up in the predetermined setting position by further pushing in the X-direction, while the shutter member 204 is displaced to the open position. In response to pushing the toner cartridge 200, the follower member starts engaging with the side portion of the cartridge body and then the rotatable member starts rotating.

5) The shutter member 204 and the guide member 201 engaged therewith are put aside in an escape position. In this escape position, while the shutter member 204 comes in contact with the toner cartridge 200, the bias of the the hook member 304 is exerted in order that the guide tray 203 and the shutter member 204 are maintained in the escape position, and therefore the toner cartridge 200 is positioned in the setting position and prevented from being pulled out from the setting position. Also, the rotatable member can rotate until the shaft formed on the side surface thereof comes in contact with the end of the long hole of the guide member.

6) Next, if it is desired to pull out the toner cartridge 200, the process is reversed to pull out the toner cartridge 200 while, during the pull out operation, the shutter member 204 is disengaged from the guide member after the shutter member 204 is locked in the close position to close the toner cartridge.

In accordance with the present embodiment, the toner cartridge 200 cannot be pulled out unless the toner pouring opening is fully closed by the shutter member 204. Accordingly, when the toner cartridge 200 is pulled out, it is possible to surely prevent residual toner from spilling out of the inside of the toner cartridge 200.

Also, since the insertion and removal of the toner cartridge 200 can be guided by the guide tray 203, it is possible to more smoothly insert and remove the toner cartridge 200. In addition to this, since the guide tray 203 is provided for holding the shutter member 204, the shutter member 204 need not be supported by hand, and therefore the replacement of the toner cartridge 200 becomes easy.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A toner cartridge configured to be removably set in a predetermined setting position of a main unit of a toner supply apparatus in a predetermined insertion direction alonga guide member which is engageable with the main unit of the toner supply apparatus, said toner cartridge comprising:

a rotary transport mechanism that contains a toner therein, has a toner pouring opening, and is configured to transport the toner contained therein to the toner pouring opening;

a toner cartridge body having a flange portion;

a shutter member provided on said toner cartridge body, and configured to freely slide between a close position in which said toner pouring opening is closed and an open position in which said toner pouring opening is opened;

a first engagement member that engages with this shutter member and, when said toner cartridge is inserted into apredetermined setting position of the main unit of said toner supply apparatus, restricts the movement of said shutter member in the direction opposite the insertion direction in relation to the main unit of said toner supply apparatus and engages with a predetermined member of the main unit of said toner supply apparatus;

a second engagement member that engages with said toner cartridge body and/or said shutter member, and restricts said shutter member to the close position when said toner cartridgeis replaced from the predetermined setting position of the main unit of said toner supply apparatus; and an engagement release mechanism that, when said toner cartridge is replaced, engages with the predetermined member of the main unit of said toner supply apparatus in order to release the engagement of said first engagement member, and restricts said shutter member to the close position by slidingsaid toner cartridge body in the removal direction and engaging said toner cartridge body with said second engagement member.

2. The toner cartridge of claim 1, wherein said first engagement member is a locking mechanismwhich includes a flexible hook member capable of being hooked to a side portion of said toner cartridge body, and aligns said toner pouring opening of said toner cartridge body and a toner supply opening of said toner supply apparatus with each other in the vertical direction when said toner cartridge is located in the predetermined setting position of the main unit of said toner supply apparatus.

3. The toner cartridge of claim 2, wherein said flexible hook member is made of polypropylene.

4. The toner cartridge of claim 1, wherein said engagement release mechanism is provided with a rotatable member having a lever member, a restriction member configured to permit the rotation of this rotatable member but restrict the rotation within a predetermined range, and a follower member which is located in a position displaced from the rotation center of this rotatable member, engaged with the side portion of said toner cartridge body, and capable of moving in a straight line as the rotatable member rotates.

* * * * *